US011143193B2

(12) United States Patent
Yan et al.

(10) Patent No.: US 11,143,193 B2
(45) Date of Patent: Oct. 12, 2021

(54) UNLOADING DEVICE FOR HVAC COMPRESSOR WITH MIXED AND RADIAL COMPRESSION STAGES

(71) Applicant: Danfoss A/S, Nordborg (DK)

(72) Inventors: Jin Yan, Tallahassee, FL (US); Lin Xiang Sun, Tallahassee, FL (US); Arnold Martin Schaefer, Wellington, FL (US); Ruiguo Gao, Talahassee, FL (US)

(73) Assignee: DANFOSS A/S

( * ) Notice: Subject to any disclaimer, the term of this patent is extended or adjusted under 35 U.S.C. 154(b) by 140 days.

(21) Appl. No.: 16/515,668

(22) Filed: Jul. 18, 2019

(65) Prior Publication Data

US 2020/0208642 A1 Jul. 2, 2020

Related U.S. Application Data

(60) Provisional application No. 62/787,504, filed on Jan. 2, 2019, provisional application No. 62/822,113, filed on Mar. 22, 2019.

(51) Int. Cl.

| | |
|---|---|
| ***F04D 27/02*** | (2006.01) |
| ***F04D 17/10*** | (2006.01) |
| ***F25B 1/053*** | (2006.01) |

(52) U.S. Cl.

CPC ..... *F04D 27/0207* (2013.01); *F04D 17/10* (2013.01); *F04D 27/0246* (2013.01); *F25B 1/053* (2013.01)

(58) Field of Classification Search

None

See application file for complete search history.

(56) References Cited

U.S. PATENT DOCUMENTS 3,520,138 A * 7/1970 Fox ..... F02C 7/36 60/226.1
4,047,379 A * 9/1977 Brookes ..... G01K 13/028 60/39.093
4,195,473 A * 4/1980 Aspinwall ..... F01D 5/048 60/794
4,573,864 A * 3/1986 Moore ..... F04D 23/008 415/55.2
4,978,277 A * 12/1990 Moore ..... F01D 1/14 415/55.6

(Continued)

FOREIGN PATENT DOCUMENTS

WO 2018038818 3/2018

OTHER PUBLICATIONS

Extended EP Search Report for EP Application No. 19208389.7 dated Apr. 29, 2020.

*Primary Examiner* — Michael Lebentritt

(74) *Attorney, Agent, or Firm* — Carlson, Gaskey & Olds, P.C.

(57) ABSTRACT

A refrigerant compressor according to an exemplary aspect of the present disclosure includes, among other things, an impeller arranged in a main flow path and including a plurality of vanes. The impeller is configured to rotate about an axis. A channel is outside the main flow path. A first orifice fluidly couples the channel to the main flow path upstream of the vanes, and a second orifice fluidly couples the channel to the main flow path downstream of leading edges of the vanes.

18 Claims, 11 Drawing Sheets

(56) References Cited

U.S. PATENT DOCUMENTS

| | | | | |
|---|---|---|---|---|
| 2002/0106278 | A1* | 8/2002 | Koga | F04D 17/122 415/211.2 |
| 2005/0152775 | A1* | 7/2005 | Japikse | F04D 29/685 415/1 |
| 2006/0147301 | A1* | 7/2006 | Ueda | F25B 49/025 415/144 |
| 2008/0253877 | A1* | 10/2008 | Bodell | F04D 27/0253 415/13 |
| 2009/0263234 | A1 | 10/2009 | Yin | |
| 2010/0263391 | A1* | 10/2010 | Tetu | F25B 1/053 62/89 |
| 2013/0051996 | A1* | 2/2013 | Hoeger | F01D 9/041 415/185 |
| 2014/0202202 | A1* | 7/2014 | Taguchi | F04D 29/682 62/510 |
| 2014/0208788 | A1* | 7/2014 | Brasz | F04D 27/0215 62/228.5 |
| 2015/0128640 | A1* | 5/2015 | Sun | F25B 41/20 62/498 |
| 2017/0198720 | A1* | 7/2017 | Umeda | F04D 29/284 |
| 2017/0260987 | A1* | 9/2017 | Onodera | F04D 29/462 |
| 2020/0109879 | A1* | 4/2020 | Sun | F04D 17/06 |

* cited by examiner

UNLOADING DEVICE FOR HVAC COMPRESSOR WITH MIXED AND RADIAL COMPRESSION STAGES

PRIORITY CLAIM

This application claims the benefit of U.S. Provisional Application No. 62/787,504, filed on Jan. 2, 2019 and U.S. Provisional Application No. 62/822,113, filed on Mar. 22, 2019.

TECHNICAL FIELD

This disclosure relates to a refrigerant compressor with a passive unloading feature. The compressor may be used in a heating, ventilation, and air conditioning (HVAC) chiller system, for example.

BACKGROUND

Refrigerant compressors are used to circulate refrigerant in a chiller via a refrigerant loop. Refrigerant loops are known to include a compressor, a condenser, an expansion device, and an evaporator. The compressor compresses the fluid, which then travels to the condenser, which in turn cools and condenses the fluid. The refrigerant then goes to the expansion device, which decreases the pressure of the fluid, and to the evaporator, where the fluid is vaporized, completing a refrigeration cycle.

Many refrigerant compressors are centrifugal compressors and have an electric motor that drives at least one impeller to compress refrigerant. Fluid flows into the impeller in an axial direction, and is expelled radially from the impeller. The fluid is then directed downstream for use in the chiller system.

SUMMARY

A refrigerant compressor according to an exemplary aspect of the present disclosure includes, among other things, an impeller arranged in a main flow path and including a plurality of vanes. The impeller is configured to rotate about an axis. A channel is outside the main flow path. A first orifice fluidly couples the channel to the main flow path upstream of the vanes, and a second orifice fluidly couples the channel to the main flow path downstream of leading edges of the vanes.

In a further embodiment, the channel is configured to extend an operating range of the compressor.

In a further embodiment, when the compressor is operating at a low capacity, a portion of the fluid in the main flow path is configured to enter the channel via the second orifice and be reintroduced into the main flow path via the first orifice.

In a further embodiment, when the compressor is operating at a high capacity, a portion of the fluid in the main flow path is configured to enter the channel via the first orifice and be reintroduced into the main flow path via the second orifice.

In a further embodiment, the plurality of vanes includes main vanes and splitter vanes, and wherein the second orifice couples the channel to the main flow path downstream of leading edges of the splitter vanes.

In a further embodiment, the impeller is part of a mixed compression stage, the mixed compression stage having both axial and radial components, the mixed compression stage having an inlet and an outlet.

In a further embodiment, a radial compression stage is arranged in the main refrigerant flow path downstream of the mixed compression stage.

In a further embodiment, the impeller is part of a radial compression stage.

In a further embodiment, the second orifice is upstream of trailing edges of the vanes.

In a further embodiment, a plurality of variable inlet guide vanes are arranged upstream of the inlet.

In a further embodiment, the channel extends substantially axially relative to the axis.

In a further embodiment, the channel extends both circumferentially and axially relative to the axis.

In a further embodiment, a deswirl vane is arranged within the channel.

In a further embodiment, the refrigerant compressor is used in a heating, ventilation, and air conditioning (HVAC) chiller system.

A refrigerant system according to an exemplary aspect of the present disclosure includes, among other things, a main refrigerant loop including a compressor, a condenser, an evaporator, and an expansion device. The compressor includes an impeller arranged in a main flow path and including a plurality of vanes. The impeller is configured to rotate about an axis. A channel is outside the main flow path. A first orifice fluidly couples the channel to the main flow path upstream of the vanes, and a second orifice fluidly couples the channel to the main flow path downstream of leading edges of the vanes.

In a further embodiment, the impeller is part of a mixed compression stage, the mixed compression stage having both axial and radial components, the mixed compression stage having an inlet and an outlet.

In a further embodiment, the impeller is part of a radial flow compression stage.

In a further embodiment, the second orifice is upstream of trailing edges of the vanes.

In a further embodiment, the channel extends substantially axially relative to the axis.

In a further embodiment, the channel extends both circumferentially and axially relative to the axis.

DETAILED DESCRIPTION

Figure 1:
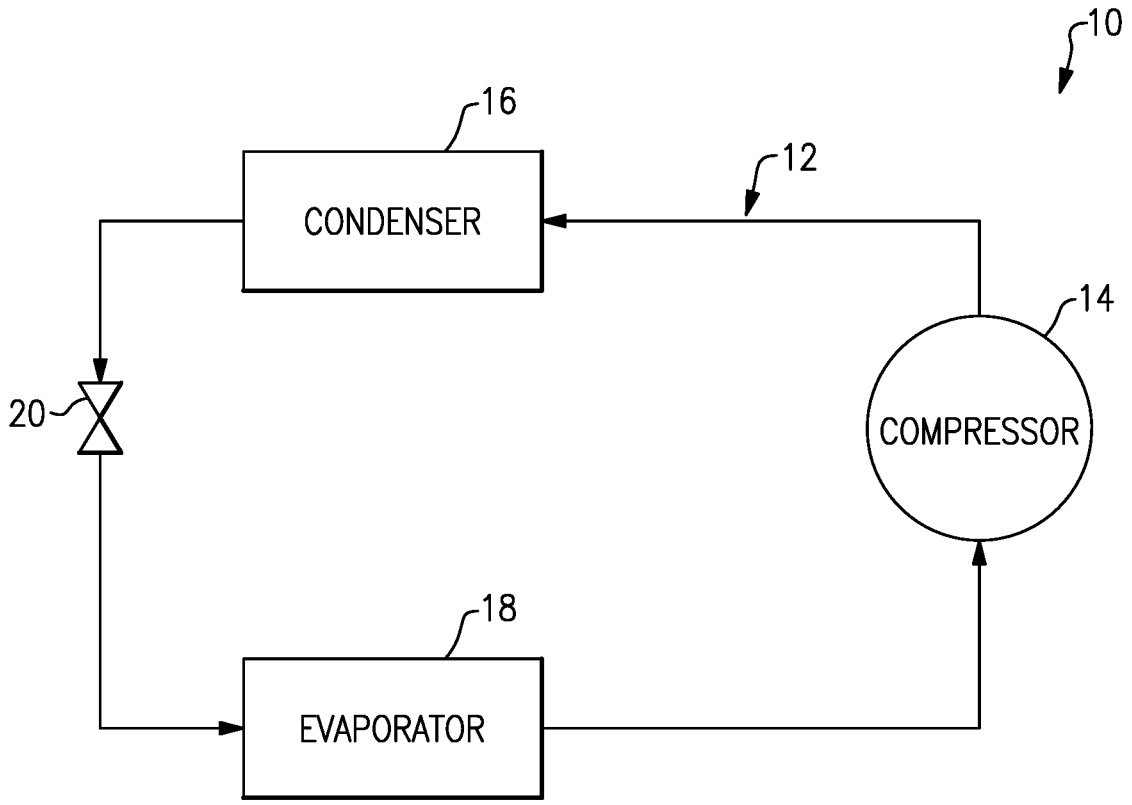
FIG. 1 schematically illustrates a refrigerant system.

FIG. 1 illustrates a refrigerant system 10. The refrigerant system 10 includes a main refrigerant loop, or circuit, 12 in communication with a compressor 14, a condenser 16, an evaporator 18, and an expansion device 20. This refrigerant system 10 may be used in a chiller, for example. In that example, a cooling tower may be in fluid communication with the condenser 16. While a particular example of the refrigerant system 10 is shown, this application extends to other refrigerant system configurations, including configurations that do not include a chiller. For instance, the main refrigerant loop 12 can include an economizer downstream of the condenser 16 and upstream of the expansion device 20.

Figure 2:
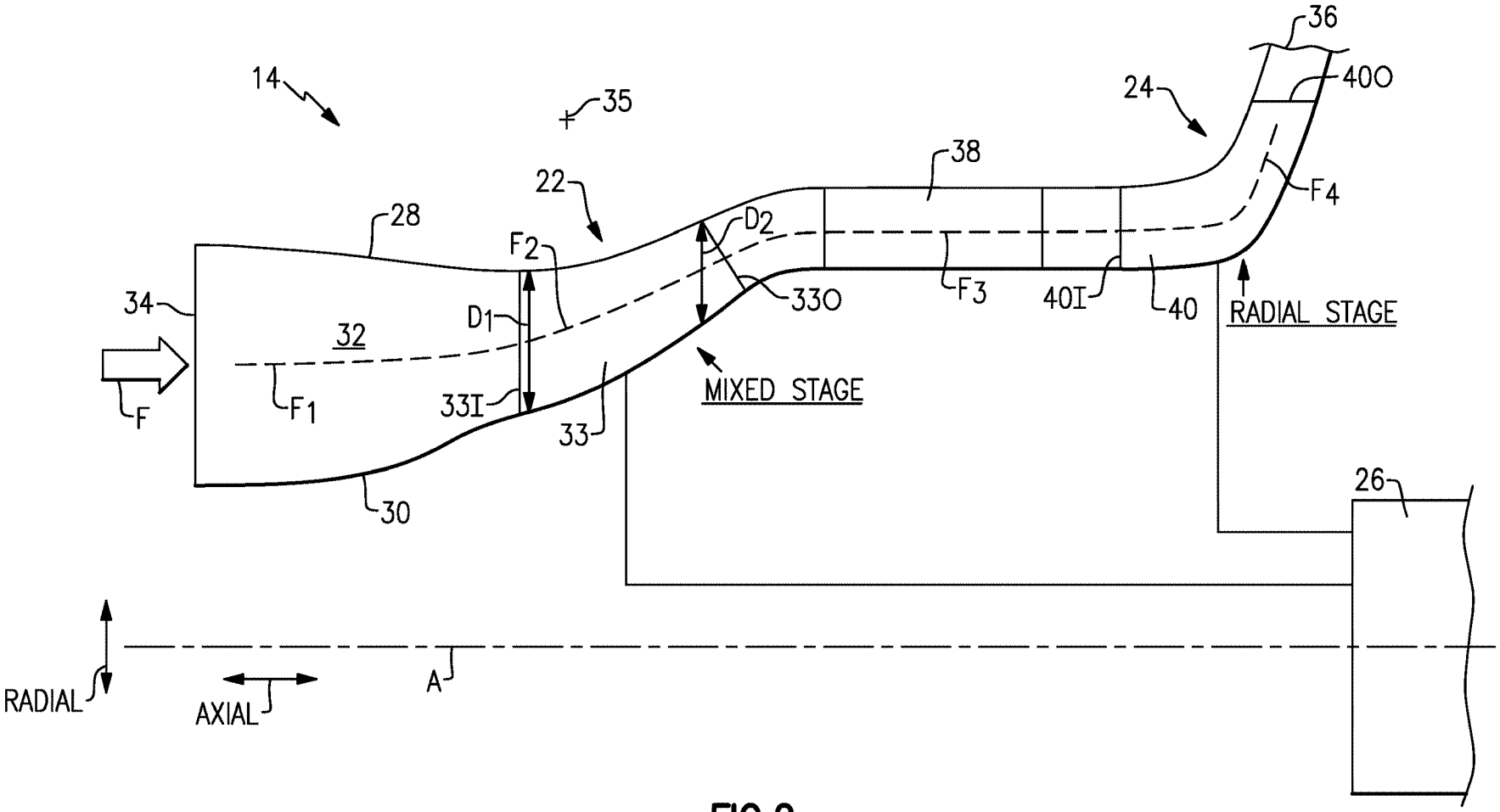
FIG. 2 schematically illustrates a first example compressor having two compression stages, with a first compression stage being a mixed compression stage and a second compression stage being a radial compression stage.

FIG. 2 schematically illustrates a first example refrigerant compressor according to this disclosure. In FIG. 2, a portion of the compressor 14 is shown in cross-section. It should be understood that FIG. 2 only illustrates an upper portion of the compressor 14, and that the compressor 14 would essentially include the same structure reflected about its central longitudinal axis A.

In this example, the compressor 14 has two compression stages 22, 24 spaced-apart from one another along the axis A. The compression stages 22, 24 each include a plurality of blades (e.g., an array of blades) arranged on a disk, for example, and rotatable about the axis A via a motor 26. In this example, the motor 26 is an electric motor arranged about the axis A. The compression stages 22, 24 may be coupled to the motor 26 by separate shafts or by a common shaft. Two shafts are shown schematically in FIG. 2.

The compressor 14 includes an outer wall 28 and an inner wall 30 which together bound a main flow path 32. The main flow path 32 extends between an inlet 34 and an outlet 36 of the compressor 14. The outer and inner walls 28, 30 may be provided by one or more structures.

Between the inlet 34 and the first compression stage 22, fluid F within the main flow path 32 flows in a first direction $F_1$, which is an axial direction substantially parallel to the axis A. The "axial" direction is labeled in FIG. 2 for reference. The fluid F is refrigerant in this disclosure.

The first compression stage 22 includes a plurality of blades 33 arranged for rotation about the axis A. Adjacent the inlet 33I of the first compression stage 22, the outer and inner walls 28, 30 are spaced-apart by a radial distance $D_1$. Adjacent the outlet 33O of the first compression stage 22, the outer and inner walls 28, 30 are spaced-apart by a radial distance $D_2$, which is less than $D_1$. The distances $D_1$ and $D_2$ are measured normally to the axis A.

Within the first compression stage 22, the outer and inner walls 28, 30 are arranged such that the fluid F is directed in a second direction $F_2$, which has both axial and radial components. In this regard, the first compression stage 22 may be referred to as a "mixed" compression stage, because the fluid F within the first compression stage 22 has both axial and radial flow components. The "radial" direction is labeled in FIG. 2 for reference.

In one example, the second direction $F_2$ is inclined at an angle of less than 45° relative to the first direction $F_1$ and relative to the axis A. In this way, the second direction $F_2$ is primarily axial but also has a radial component (i.e., the axial component is greater than the radial component).

Further, between the inlet 33I and outlet 33O, the inner and outer walls 28, 30 are not straight. Rather, the inner and outer walls 28, 30 are curved. Specifically, in this example, the inner and outer walls 28, 30 are curved such that they are generally concave within the first compression stage 22 when viewed from a radially outer location, such as the location 35 in FIG. 2. Thus, the fluid F smoothly transitions from a purely axial flow to a flow having both axial and radial components.

Downstream of the first compression stage 22, the outer and inner walls 28, 30 have inflection points and smoothly transition such that they are substantially parallel to one another. As such, the fluid F is directed in a third direction $F_3$, which is substantially parallel to both the first direction $F_1$ and the axis A. As the fluid F is flowing in the third direction $F_3$, the fluid F also flows through an array of static diffuser vanes 38 in this example.

Downstream of the diffuser vanes 38, the fluid F is directed to the second compression stage 24, which in this example includes an impeller 40 configured to turn the fluid F flowing in a substantially axial direction to a substantially radial direction. In particular, the impeller 40 includes an inlet 401 arranged axially, substantially parallel to the axis A, and an outlet 400 arranged radially, substantially perpendicular to the axis A.

In particular, the fluid F enters the second compression stage 24 flowing in the third direction $F_3$ and exits the second compression stage 24 flowing in a fourth direction $F_4$, which in one example is substantially parallel to the radial direction. In this disclosure, the fourth direction $F_4$ is inclined relative to the axis A at an angle greater than 45° and less than or equal to 90°. In one particular example, the fourth direction $F_4$ is substantially equal to 90°. In this way, the second compression stage 24 may be referred to as a radial compression stage.

In some examples, the compressor 14 may have two radial impellers, rather than one axial and one radial. The combination of the first compression stage 22 having both axial and radial components (i.e., second direction $F_2$ is inclined at less than 45°) with the second compression stage 24 being primarily radial (i.e., the fourth direction $F_4$ is substantially equal to 90°, the compressor 14 may be more compact than a compressor that includes two radial impellers, for example. The compressor 14 may also exhibit an increased operating range, in that it can operate without surging at lower capacities, relative to compressors with two axial impellers. Accordingly, the compressor 14 strikes a unique balance between being compact and efficient.

Figure 3:
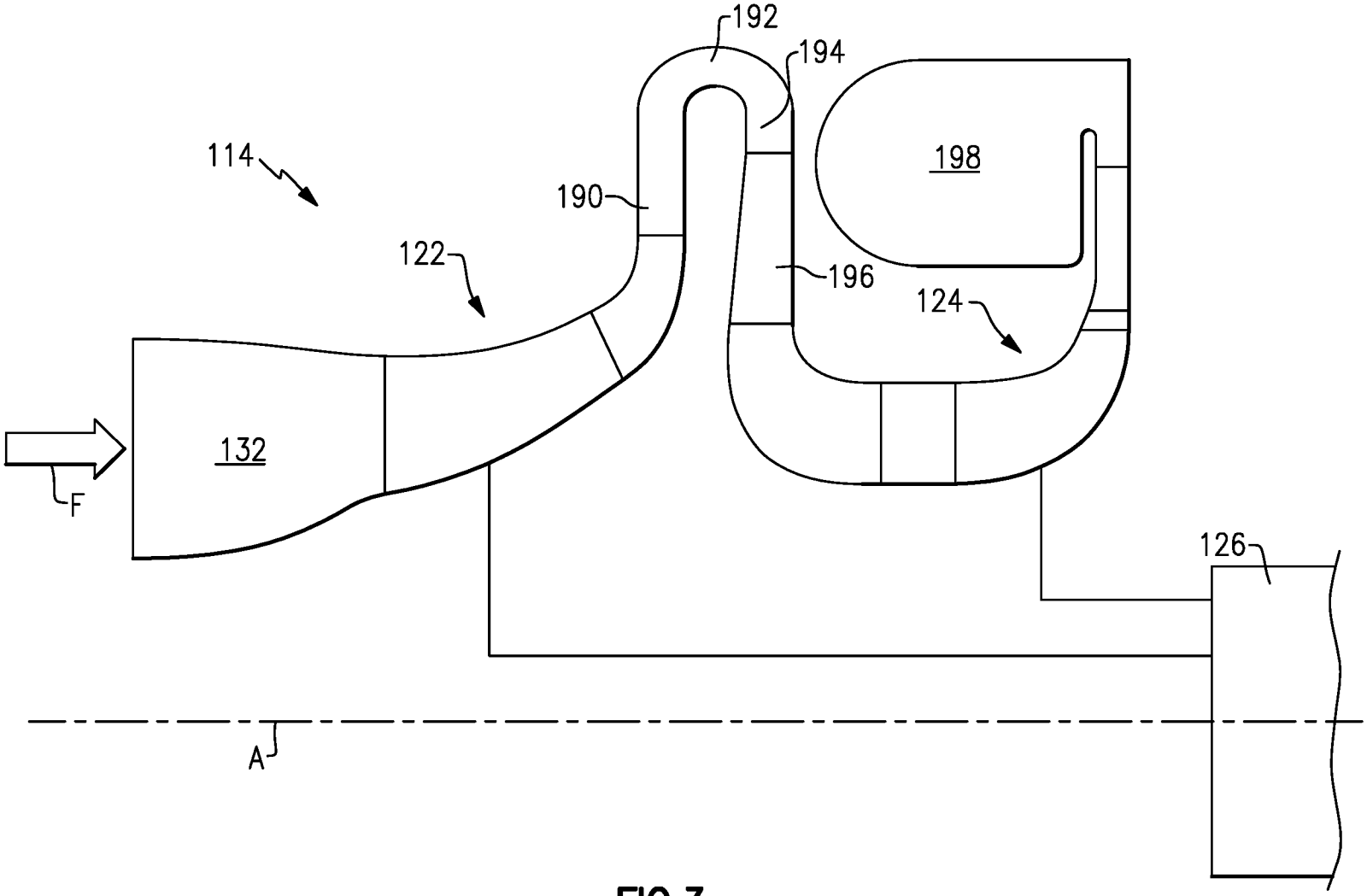
FIG. 3 schematically illustrates a second example compressor having two compression stages, with a first compression stage being a mixed compression stage and a second compression stage being a radial compression stage.

FIG. 3 schematically illustrates a second example refrigerant compressor according to this disclosure. To the extent not otherwise described or shown, the compressor 114 corresponds to the compressor 14 of FIG. 2, with like parts having reference numerals preappended with a "1."

Like the compressor 14, the compressor 114 has two compression stages 122, 124 spaced-apart from one another along an axis A. The first compression stage 122 is a "mixed" compression stage and is arranged substantially similar to the first compression stage 22. The second compression stage 124 is a radial compression stage and is likewise arranged substantially similar to the second compression stage 24.

Unlike the compressor 14, the main flow path 132 of the compressor 114 includes a 180-degree bend between the first and second compression stages 122, 124. Specifically, downstream of the first compression stage 122, the main flow path 132 turns and projects radially outward from the axis A. Specifically, the main flow path 132 is substantially normal to the axis A within a first section 190. The main flow path 132 turns again by substantially 180 degrees in a cross-over bend 192, such that the main flow path 132 projects radially inward toward the axis A in a second section 194, which may be referred to as a return channel. The second section includes deswirl vanes 196 in this example, which ready the flow of fluid F for the second compression stage 124. Further, downstream of the second compression stage 124, the compressor 114 includes an outlet volute 198 which spirals about the axis A and leads to a compressor outlet. The compressor 14 may also include an outlet volute.

In some examples, the compressor 14 may include additional features to extend the operating range of the compressor 14, such the unloading devices further described herein.

Figure 4:
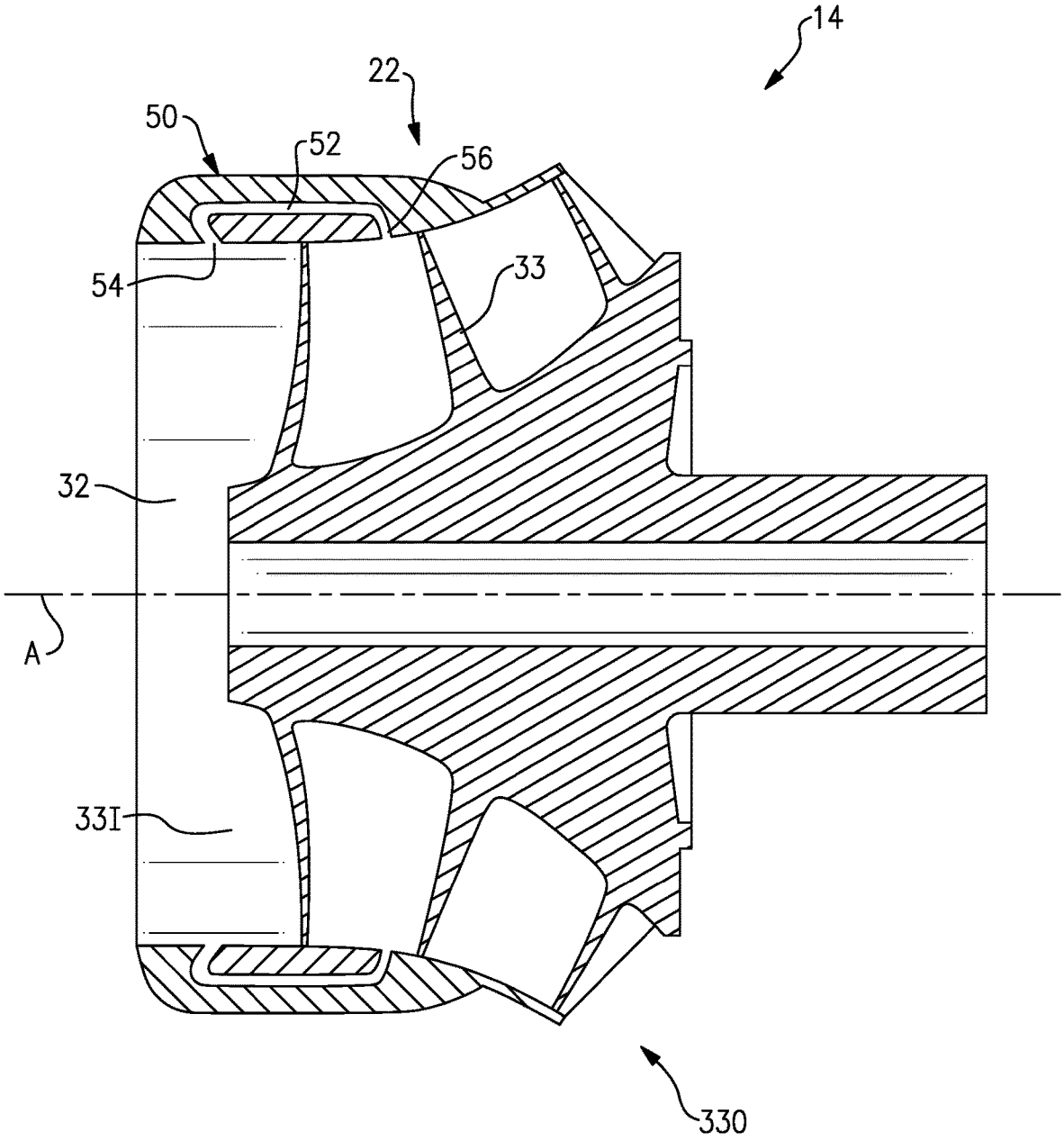
FIG. 4 is a cross-sectional illustration of a portion of an example compressor according to an embodiment.

FIG. 4 illustrates a portion of a refrigerant compressor 14 having an example unloading device 50. The unloading device 50 may be used in a mixed compression stage, such as stage 22 of compressor 14. The unloading device 50 includes a channel 52 that is fluidly coupled to the main flow path 32 via an upstream port 54 upstream of the inlet 33I and a downstream port 56 between the inlet 33I and the outlet 33O. The terms "upstream" and "downstream" are used with reference to the main flow path 32. The channel 52 is arranged radially outward of the main flow path 32. The channel 52 extends in a generally axial direction. In some embodiments, the channel 52 may also have a circumferential component about the axis A. In some embodiments, the channel 52 may extend substantially parallel to the first direction $F_1$. In other embodiments, the channel 52 may extend substantially parallel to the second direction $F_2$. In further examples, the channel 52 may have an angle in the axial direction between the first and second directions $F_1$, $F_2$.

Figure 5A:
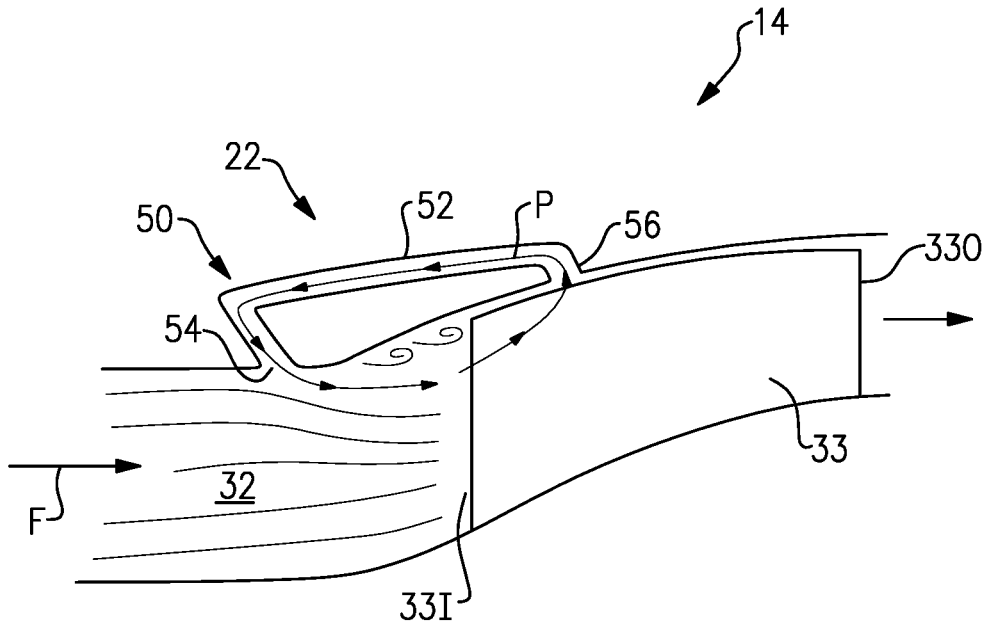
FIG. 5A schematically illustrates a portion of the example compressor.
Figure 5B:
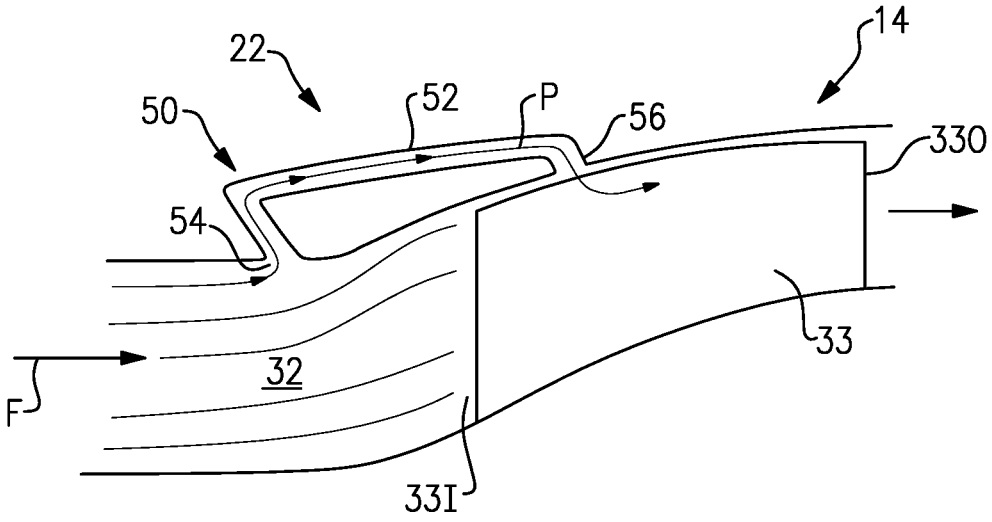
FIG. 5B schematically illustrates a portion of the example compressor.

FIGS. 5A and 5B illustrate the example unloading device 50. The channel 52 is arranged such that a portion P of the fluid F may enter the channel 52 under certain conditions, which will be explained below. The unloading device 50 alleviates the causes of choke point and surge, thereby improving performance of the compressor 14 when operating at both high and low capacities.

FIG. 5A schematically illustrates a condition where the compressor 14 is operating at a relatively low capacity and thus approaching a surge condition. In such conditions, a portion P of the flow of fluid F enters the downstream port 56, flows through the channel 52, and is expelled back into the main flow path 32 through the upstream port 54. In this way, the portion P of the fluid F is reintroduced back into the main flow path 32 upstream of the inlet 33I in a way that partially blocks the inlet 33I and simulates normal, non-surge flow conditions. With the inlet 33I partially blocked, the flow velocity increases and the correct incidence angle is restored. This thereby permits normal compressor operation even when the compressor 14 would have normally been experiencing surge conditions.

FIG. 5B schematically illustrates a condition where the compressor 14 is operating at a relatively high capacity. At high capacities, there is sometimes a choke point created in the compressor 14. The choke point may be coincident with the inlet 33I, for example. Essentially, at high capacities, fluid F is choked at the choke point, and the compressor 14 cannot compress any further refrigerant despite the rotational speed of the blades 33 increasing, for example. In this disclosure, however, during such conditions, a portion P of the fluid F may enter the channel 52 via the upstream port 54, bypass the choke point, and be reintroduced into the main flow path 32 via the downstream port 56. To be clear, in this condition, the portion P flows through the channel 52 in a direction generally opposite that shown in FIG. 5A. In this way, the compressor 14 may operate at higher capacities by porting some of the fluid F around the choke point, increasing the area for the fluid to pass through.

This disclosed unloading device 50 thus extends the useful operating range of the compressor 14, and in particular the mixed-flow compression stage 22 at both low and high capacities. The unloading device 50 passively controls the flow while not requiring any active moving components.

Figure 6:
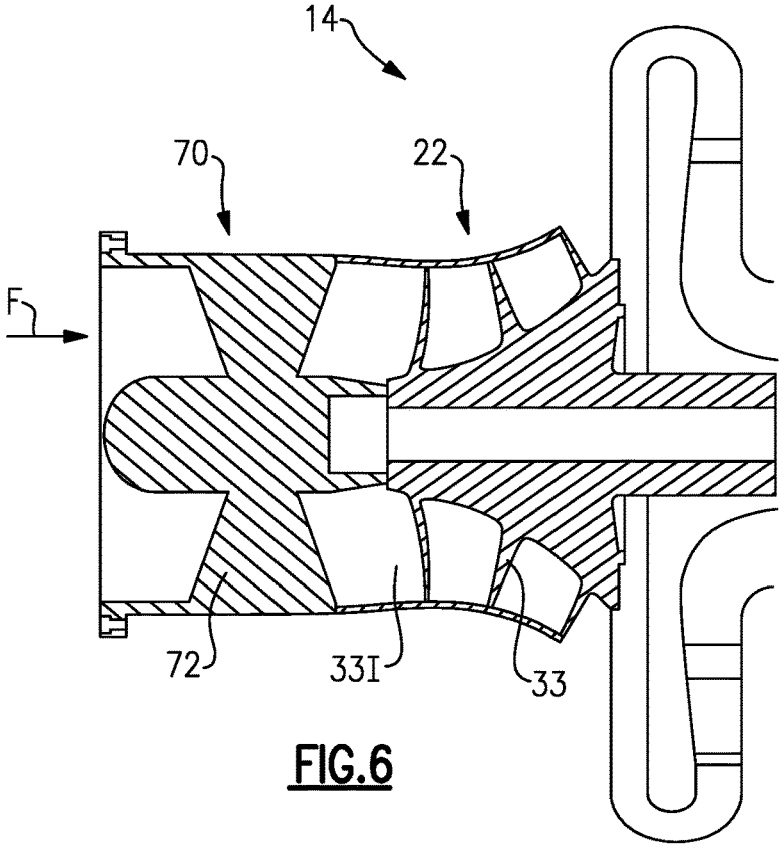
FIG. 6 is a cross-sectional illustration of a portion of an example compressor according to another embodiment.

FIG. 6 illustrates a portion of a refrigerant compressor 14 having another example unloading device 70. The unloading device 70 has a plurality of inlet guide vanes 72 spaced circumferentially about the axis A. The inlet guide vanes 72 are variable inlet guide vanes that change angle during operation. That is, each inlet guide vane 72 rotates about an axis that extends in a radial direction. The angle of the inlet guide vanes 72 changes the angle of the flow F at the inlet 33I. The angle of the inlet guide vanes 72 permits pre-swirl of the flow F, which may help increase the axial component of the fluid velocity. This increased velocity in the axial direction may reduce the chance of stall, and thus reduce the chance of surge.

Figure 7:
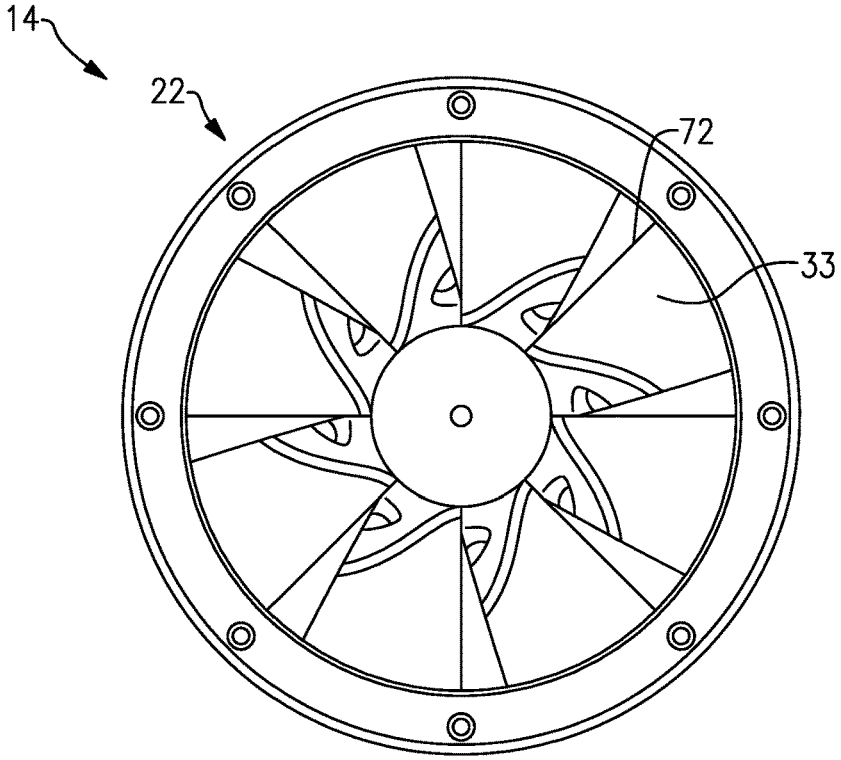
FIG. 7 is a front view of a portion of the example compressor.

FIG. 7 illustrates a front view of the inlet guide vanes 72. In this example, eight inlet guide vanes 72 are arranged circumferentially about the axis A. More or fewer inlet guide vanes 72 may be used in some examples.

In some examples, the compressor 14 may utilize one of the unloading devices 50, 70, or both unloading devices 50, 70 together. The unloading devices 50, 70 may be used at one or both compressor stage 22, 24. In some examples, the unloading device 50 may be used at one stage, while the unloading device 70 is used at the other stage.

Figure 8:
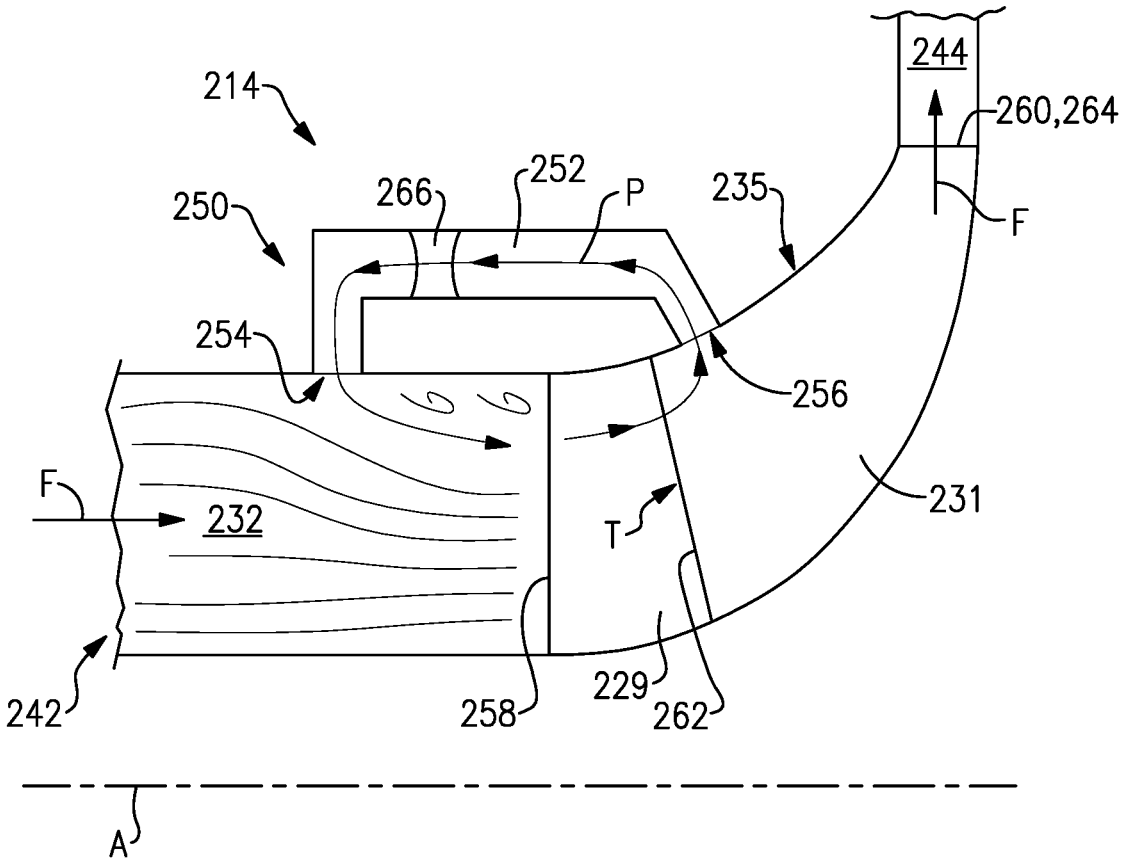
FIG. 8 is a cross-sectional, schematic illustration of a portion of an example compressor according to another embodiment.
Figure 9:
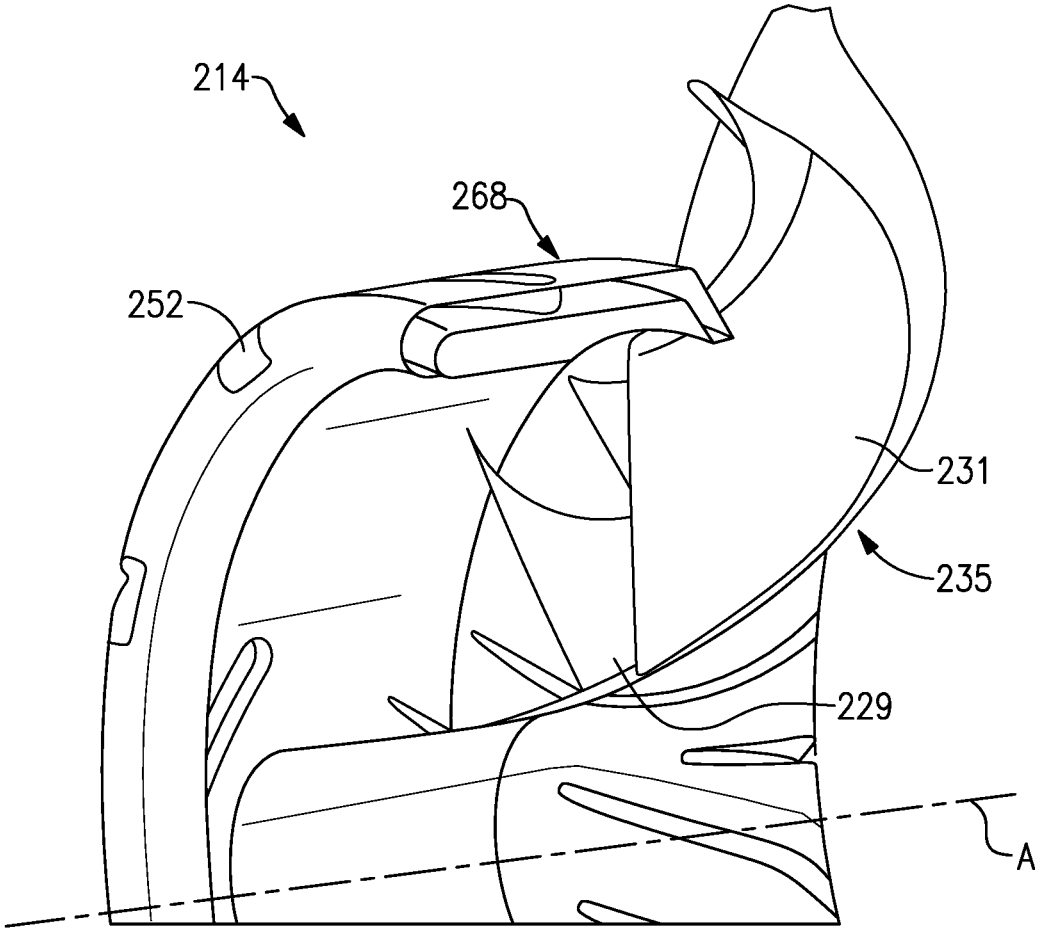
FIG. 9 is a cross-sectional, perspective illustration of a portion of the example compressor.
Figure 10:
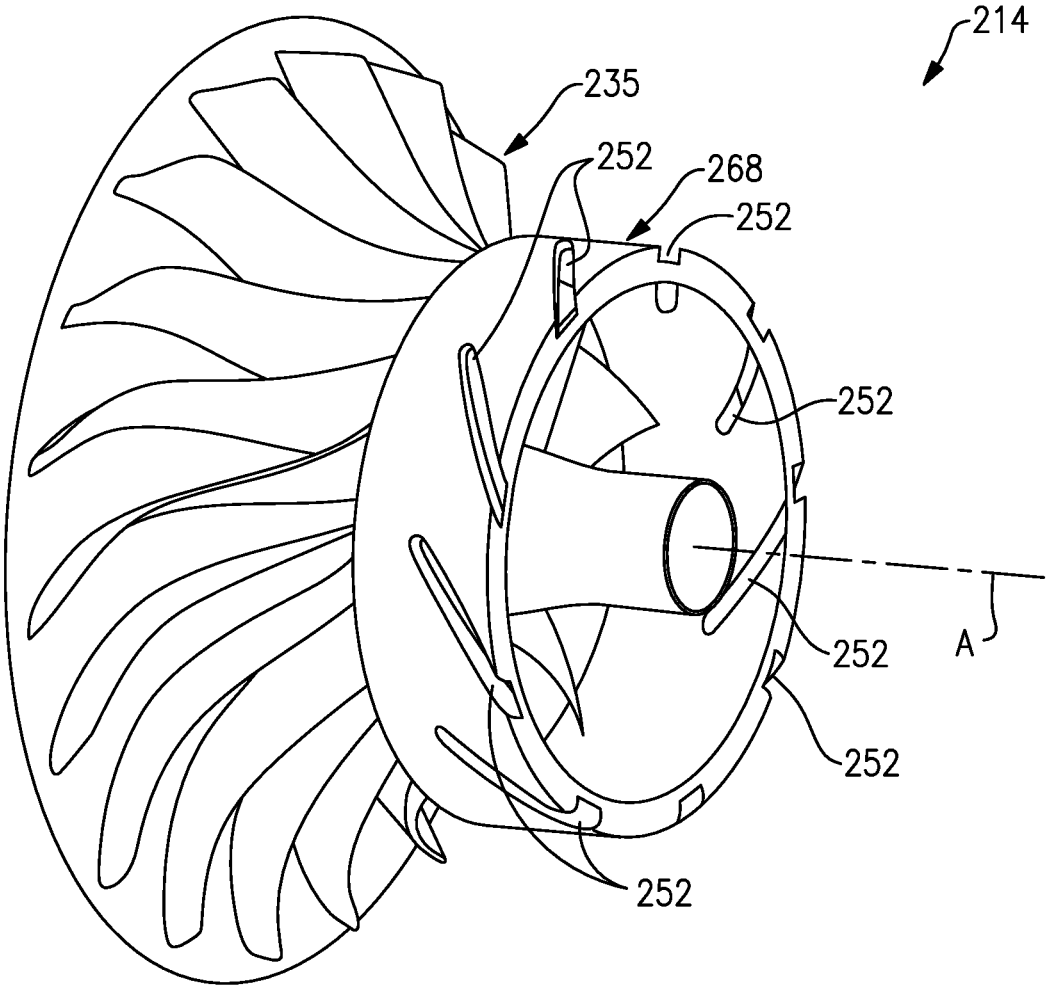
FIG. 10 is a perspective illustration of a portion of the example compressor.

FIGS. 8-10 show another example compressor 214 having an unloading device at a radial impeller. FIG. 8 is a schematic, cross-sectional view of a portion of an example compressor 214 according to another embodiment. The compressor 214 in this example is a centrifugal compressor including an impeller 235. The impeller 226 is rotationally driven by a motor (not shown), and is configured to rotate about a central axis A of the compressor 214. The impeller 235 in this example includes two types of vanes: main vanes 229 and splitter vanes 231.

The main vanes 229 have a leading edge 258 and a trailing edge 260. The splitter vanes 231 have a leading edge 262 downstream of the leading edge 258 of the main vanes 229. The splitter vanes 231 further have a trailing edge 264 that extends to the same downstream location as the trailing edge 260 of the main vanes 229. The splitter vanes 231 permit a higher mass flow rate through the impeller 235 compared to impellers without splitter vanes. The impeller 235 may be arranged such that the main vanes 229 and splitter vanes 231 are in an alternating arrangement about the circumference of the impeller 235. Other arrangements come within the scope of this disclosure, however.

The compressor 214 includes a main flow path 232. Fluid, namely refrigerant, F is configured to flow through the main flow path 232 from the inlet 242 of the compressor 214 to a location 244 downstream of the impeller 235. The impeller 235 is arranged in the main flow path 232. Downstream of the location 244, the fluid F may flow to another impeller or to an outlet volute, as examples. As is known of centrifugal compressors, the fluid F flows in a directional parallel to the axis A in the inlet 242, and the impeller 235 is configured to turn the fluid F such that it flows in a radial direction normal to the axis A at the downstream location 244.

The compressor 214 also includes a passive unloading feature 250. The passive unloading feature includes a channel 252. The channel 252 is fluidly coupled to the main flow path 232 via an upstream orifice 254 and a downstream orifice 256. The terms "upstream" and "downstream" are used with reference to the main flow path 232. The upstream orifice 254 is located upstream of the leading edge 258, and the downstream orifice 256 is located downstream of the leading edge 258 and upstream of the trailing edges 260, 264. In a particular example, the downstream orifice 256 is located downstream of the leading edge 262 of the splitter vane 231 and upstream of the trailing edges 260, 264.

The channel 252 is arranged such that a portion P of the fluid F may enter the channel 252 under certain conditions, which will be explained below. The channel 252 is radially outside of the main flow path 232 in this example. The channel 252 may be formed partially by an insert 268, such as that shown in FIGS. 9 and 10, and may be surrounded by a shroud. The insert 268 may define a plurality of channels 252, as can be seen in FIG. 10, circumferentially spaced-apart from one another about the axis A.

Further, as can perhaps be best seen in FIG. 10, the channels 252 do not extend in a direction parallel the axis A between the orifices 254, 256. Rather, the channels 252 are essentially helical, and specifically they rotate circumferentially about the axis A as they move along the axis A. The channels 252 may further include deswirl vanes 266. The deswirl vanes 266 and the helical arrangement of the channels 252 causes fluid within the channels 252 to straighten, which improves the efficiency of the passive unloading feature.

The passive unloading feature alleviates the causes of both choke point and surge, thereby improving performance of the compressor 214 when operating at both high and low capacities. FIG. 8 is representative of a condition where the compressor 214 is operating at a relatively low capacity and thus approaching a surge condition. In a such conditions, a portion P of the flow of fluid F enters the downstream orifice 256, flows through the channel 252, and is expelled back into the main flow path 232 through the upstream orifice 254. In this way, the portion P of the fluid F is reintroduced back into the main flow path 232 upstream of the leading edge 258 in a way that partially blocks the inlet 242 and simulates normal, non-surge flow conditions, and thereby permits normal compressor operation even when the compressor 214 would have normally been experiencing surge conditions.

On the other hand, when the compressor 214 is operating at relatively high capacities, there is sometimes a choke point created at the throat T of the compressor 214. The throat T in this example is coincident with the leading edge 262 of the splitter vanes 231. Essentially, at high capacities, fluid F is essentially choked at the choke point, and the compressor 214 cannot compress any further refrigerant despite the rotational speed of the impeller 235 increasing, for example. In this disclosure, however, during such conditions a portion P of the fluid F may enter the channel 252 via the upstream orifice 254, bypass the throat T (i.e., the choke point), and be reintroduced into the main flow path 232 via the downstream orifice 256. To be clear, in this condition, the portion P flows through the channel 252 in a direction generally opposite that shown in FIG. 8. In this way, the compressor 214 may operate at higher capacities by porting some of the fluid F around the choke point. This disclosure extends the useful operating range of the compressor 214 at both low and high capacities.

As is shown in FIG. 10, the channels 252 in the insert 268 extend along the axis A, as well as circumferentially about the axis A. That is, the channels 252 extend helically about the axis A. The channels 252 direct the portion P of the fluid F to flow in both an axial and circumferential direction. Multiple channels 252 are spaced circumferentially about the axis A. That is, there will be multiple inlets and outlets spaced about the flow path 232.

Figure 11:
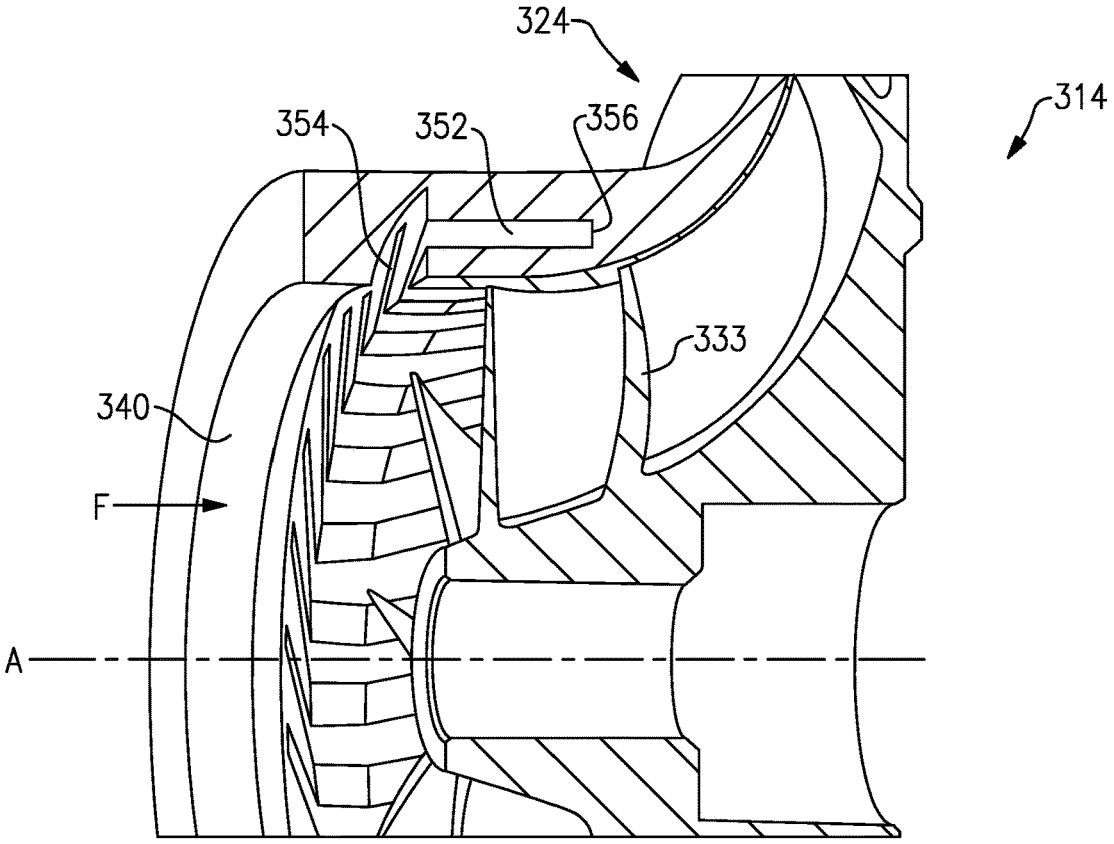
FIG. 11 is a cross-sectional, perspective illustration of a portion of an example compressor according to another embodiment.
Figure 12:
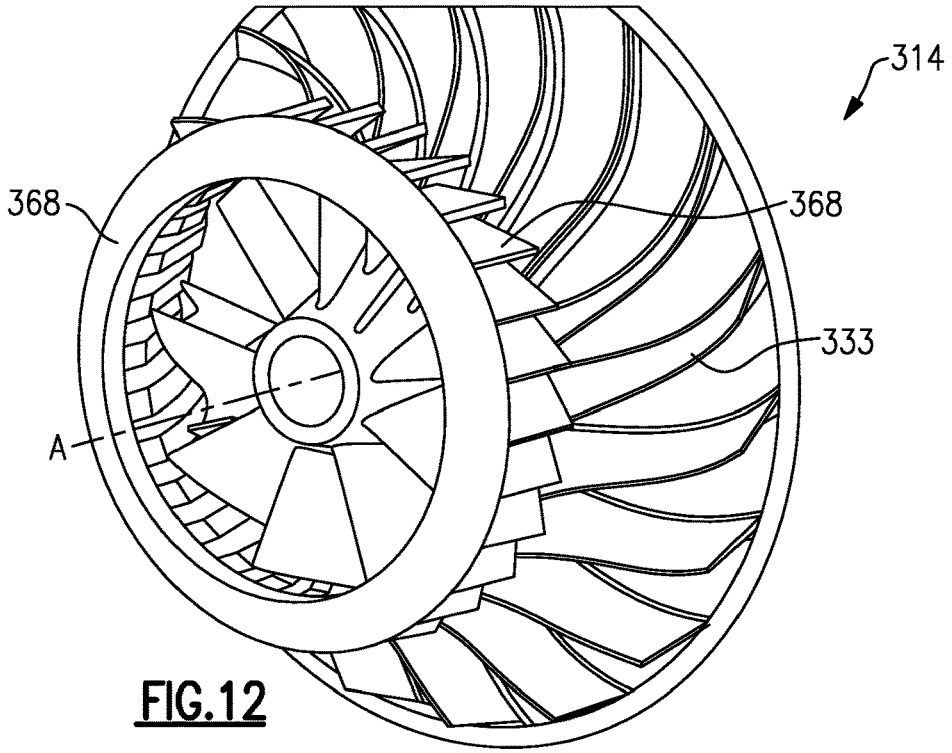
FIG. 12 is a perspective illustration of a portion of the example compressor.

FIGS. 11 and 12 illustrate another example unloading device 350 arranged at a radial impeller. In this example, the channels 352 are formed by the insert 368. Each of the channels 352 extends axially along the axis A. In this example, the channels 352 direct the portion P of the fluid flow F in an axial direction, without a circumferential component.

Figure 13:
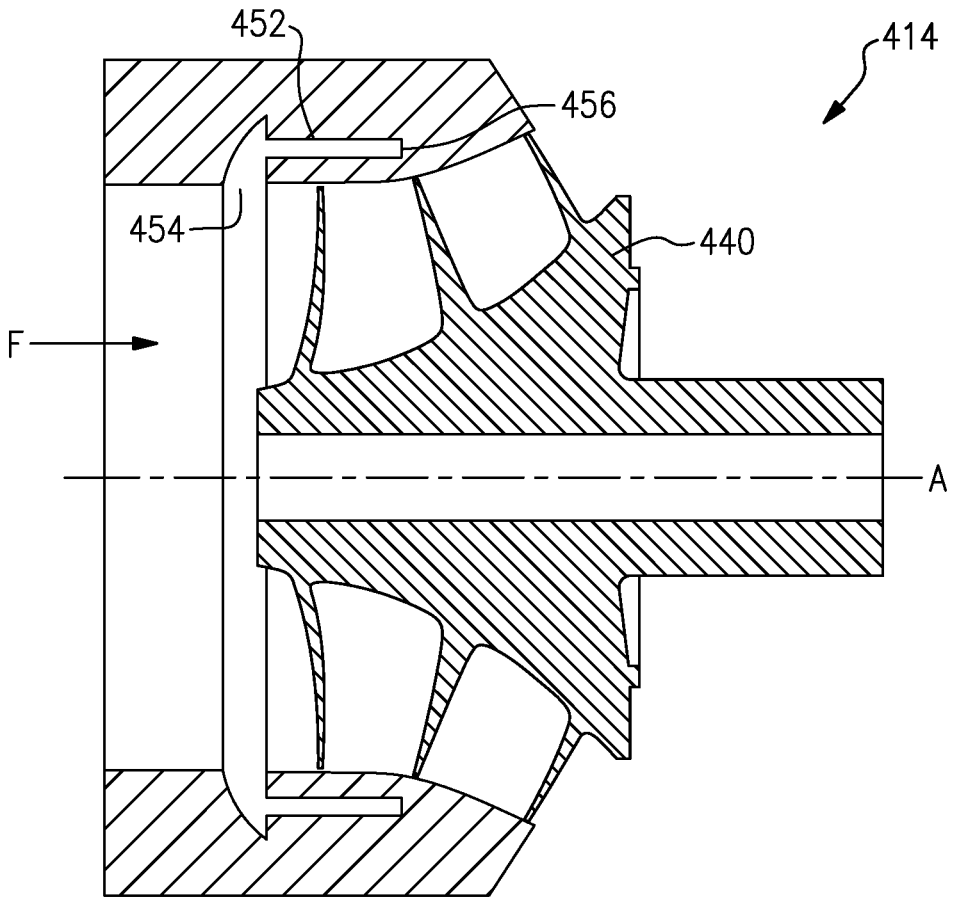
FIG. 13 is a cross-sectional, schematic illustration of a portion of an example compressor according to another embodiment.

FIG. 13 illustrates the example unloading device 350 arranged in a mixed flow compressor. The impeller 440 has both an axial and a radial component. The channels 452 extend axially along the axis A and have an axial component. The channels 452 do not direct fluid in a circumferential direction. In some examples, the channels 452 do not have a radial component. The described unloading devices may be used with either radial or mixed flow compression stages. A compressor may include one or more of the described unloading devices at one or more compression stages.

It should be understood that terms such as "axial" and "radial" are used above with reference to the normal operational attitude of a compressor. Further, these terms have been used herein for purposes of explanation, and should not be considered otherwise limiting. Terms such "generally," "about," and "substantially" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A refrigerant compressor, comprising:

an impeller arranged in a main flow path and including a plurality of vanes, the impeller configured to rotate about an axis; and a channel outside the main flow path, a first orifice fluidly coupling the channel to the main flow path upstream of the vanes, and a second orifice fluidly coupling the channel to the main flow path downstream of leading edges of the vanes, wherein the channel extends both circumferentially and axially relative to the axis, wherein the channel extends helically relative to the axis.

2. The refrigerant compressor as recited in claim 1, wherein the channel is configured to extend an operating range of the compressor.

3. The refrigerant compressor as recited in claim 1, wherein, when the compressor is operating at a low capacity that is near a surge condition, a portion of the fluid in the main flow path is configured to enter the channel via the second orifice and be reintroduced into the main flow path via the first orifice.

4. The refrigerant compressor as recited in claim 1, wherein, when the compressor is operating at a high capacity having a choke point, a portion of the fluid in the main flow path is configured to enter the channel via the first orifice and be reintroduced into the main flow path via the second orifice.

5. The refrigerant compressor as recited in claim 1, wherein the plurality of vanes includes main vanes and splitter vanes, and wherein the second orifice couples the channel to the main flow path downstream of leading edges of the splitter vanes.

6. The refrigerant compressor as recited in claim 1, wherein the impeller is part of a mixed compression stage, the mixed compression stage having both axial and radial components, the mixed compression stage having an inlet and an outlet.

7. The refrigerant compressor as recited in claim 6, wherein a radial compression stage is arranged in the main refrigerant flow path downstream of the mixed compression stage.

8. The refrigerant compressor as recited in claim 1, wherein the impeller is part of a radial compression stage.

9. The refrigerant compressor as recited in claim 1, wherein the second orifice is upstream of trailing edges of the vanes.

10. The refrigerant compressor as recited in claim 1, wherein a plurality of variable inlet guide vanes are arranged upstream of the inlet.

11. The refrigerant compressor as recited in claim 1, wherein the channel extends substantially axially relative to the axis.

12. The refrigerant compressor as recited in claim 1, wherein a deswirl vane is arranged within the channel.

13. The refrigerant compressor as recited in claim 1, wherein the refrigerant compressor is configured to be used in a heating, ventilation, and air conditioning (HVAC) chiller system.

14. A refrigerant system comprising:

a main refrigerant loop including a compressor, a condenser, an evaporator, and an expansion device, wherein the compressor includes:

an impeller arranged in a main flow path and including a plurality of vanes, the impeller configured to rotate about an axis; and a channel outside the main flow path, a first orifice fluidly coupling the channel to the main flow path upstream of the vanes, and a second orifice fluidly coupling the channel to the main flow path downstream of leading edges of the vanes, wherein the channel extends both circumferentially and axially relative to the axis, wherein the channel extends helically relative to the axis.

15. The refrigerant system as recited in claim 14, wherein the impeller is part of a mixed compression stage, the mixed compression stage having both axial and radial components, the mixed compression stage having an inlet and an outlet.

16. The refrigerant system as recited in claim 14, wherein the impeller is part of a radial flow compression stage.

17. The refrigerant system as recited in claim 14, wherein the second orifice is upstream of trailing edges of the vanes.

18. The refrigerant system as recited in claim 14, wherein the channel extends substantially axially relative to the axis.

* * * * *